US007403732B2

(12) United States Patent
Shimazu et al.

(10) Patent No.: US 7,403,732 B2
(45) Date of Patent: Jul. 22, 2008

(54) IMAGE FORMING APPARATUS EQUIPPED WITH LED PRINTING HEAD

(75) Inventors: Akihiko Shimazu, Hachioji (JP); Ritsuo Fujii, Hachioji (JP); Shinobu Konno, Hachioji (JP)

(73) Assignee: Konica Minolta Business Technologies, Inc. (JP)

( * ) Notice: Subject to any disclaimer, the term of this patent is extended or adjusted under 35 U.S.C. 154(b) by 183 days.

(21) Appl. No.: 11/487,726

(22) Filed: Jul. 17, 2006

(65) Prior Publication Data

US 2007/0110468 A1 May 17, 2007

(30) Foreign Application Priority Data

Nov. 15, 2005 (JP) ..... 2005-329938

(51) Int. Cl.
*G03G 21/20* (2006.01)
*G03G 21/00* (2006.01)

(52) U.S. Cl. ..... 399/92; 399/98

(58) Field of Classification Search ..... 399/91–98, 399/102, 103, 105
See application file for complete search history.

(56) References Cited

U.S. PATENT DOCUMENTS 3,814,515 A * 6/1974 Takahashi et al. ..... 399/98
4,882,605 A * 11/1989 Sakamoto ..... 399/105
6,621,995 B1 * 9/2003 Rejewski et al. ..... 399/92

FOREIGN PATENT DOCUMENTS

JP 5-177864 7/1993
JP 2004-191477 7/2004

* cited by examiner

*Primary Examiner*—Hoang Ngo
(74) *Attorney, Agent, or Firm*—Cantor Colburn LLP

(57) ABSTRACT

An image forming apparatus includes: a photoreceptor; a charger that electrically charges the photoreceptor; an exposing unit having an LED printing head that forms a latent image on the photoreceptor; a developing unit that develops a toner image corresponding to the latent image on the photoreceptor; a blower unit that sends air to a space between the photoreceptor and the LED printing head; a first shielding member provided on the charger, which intercepts the air coming from the blower unit to enter inside the charger; and a second shielding member provided on the developing unit, which intercepts the air coming from the blower unit to enter inside the developing unit.

7 Claims, 5 Drawing Sheets

IMAGE FORMING APPARATUS EQUIPPED WITH LED PRINTING HEAD

This application is based on Japanese Patent Application No. 2005-329938 filed on Nov. 15, 2005, which is incorporated hereinto by reference.

BACKGROUND OF THE INVENTION

The present invention relates to image forming apparatuses including a copying machine of an electrophotographic system, a printer and a facsimile machine, each being equipped with an LED (Light Emitting Diode) printing head.

In the image forming apparatuses such as a copying machine, a printer and a facsimile machine, each being of a digital form employing an electrophotographic technology, a laser beam and an LED array are commonly used as an exposing unit for a photoreceptor.

In the case of exposure by means of a laser beam, an exposure method used normally is one wherein a laser beam prepared by a semiconductor laser, a plurality of lenses and by a polygon mirror (rotary polygonal mirror) is oscillated in the direction perpendicular to the direction of rotation of the photoreceptor for conducting exposure.

On the other hand, with respect to exposure by means of an LED array, in the exposure method used commonly, an LED printing head that houses a base plate having therein a plurality of LEDs arranged linearly (LED array) and IC that drives the LEDs and housing a columnar lens array provided on the front side of the LED array in one outer package is arranged in the direction perpendicular to the direction of rotation of the photoreceptor to be close to the photoreceptor surface, and lighting of the LED at a prescribed position is controlled for exposure.

An exposing unit employing the LED printing head is advantageous in terms of low noise and compactness, because no component operating mechanically like a polygon mirror is in existence therein, in comparison with an exposing unit employing a laser beam. However, in the exposing unit, there is a risk of deterioration of the tip of the columnar lens array representing the tip of the LED printing head caused by ozone generated from a charging electrode of a charger, and there is also a fear that toner scattering from a developer representing a developing unit may adhere to the tip of the columnar lens array.

For eliminating these problems of the LED printing head, there are proposals including one to provide a mechanism to create an air flow on the tip of the LED printing head (for example, see Japanese Patent Application Publication No. 05-177864 (FIG. 1 on the first page)) and the other for providing a dustproof shutter (for example, see Japanese Patent Application Publication No. 2004-191477 (first page-third page)).

However, a complicated mechanism of the LED printing head often complicates maintenance work for removing dust when dust such as toner adheres to the LED printing head, which may result in a fear of a cost increase of the LED printing head itself.

SUMMARY OF THE INVENTION

In view of the aforesaid circumstances, the present invention has been achieved, and its object is to provide an image forming apparatus wherein deterioration of the tip of the LED printing head caused by ozone and adhesion of toner thereto are prevented while keeping easy maintenance work of the LED printing head.

The aforesaid object is attained by the structure described below.

An image forming apparatus has therein a photoreceptor, a charger that electrically charges the photoreceptor, an exposing unit having an LED printing head that forms a latent image on the photoreceptor, a developing unit that develops a toner image corresponding to the latent image on the photoreceptor, a blower unit that sends air to a space between the photoreceptor and the LED (Light Emitting Diode) printing head, a first shielding member that is provided on the charger and intercepts the air coming from the blower unit to enter the inside of the charger and a second shielding member that is provided on the developing unit and intercepts the air coming from the blower unit to enter the inside of the developing unit.

DETAILED DESCRIPTION OF THE PREFERRED EMBODIMENT

Figure 1:
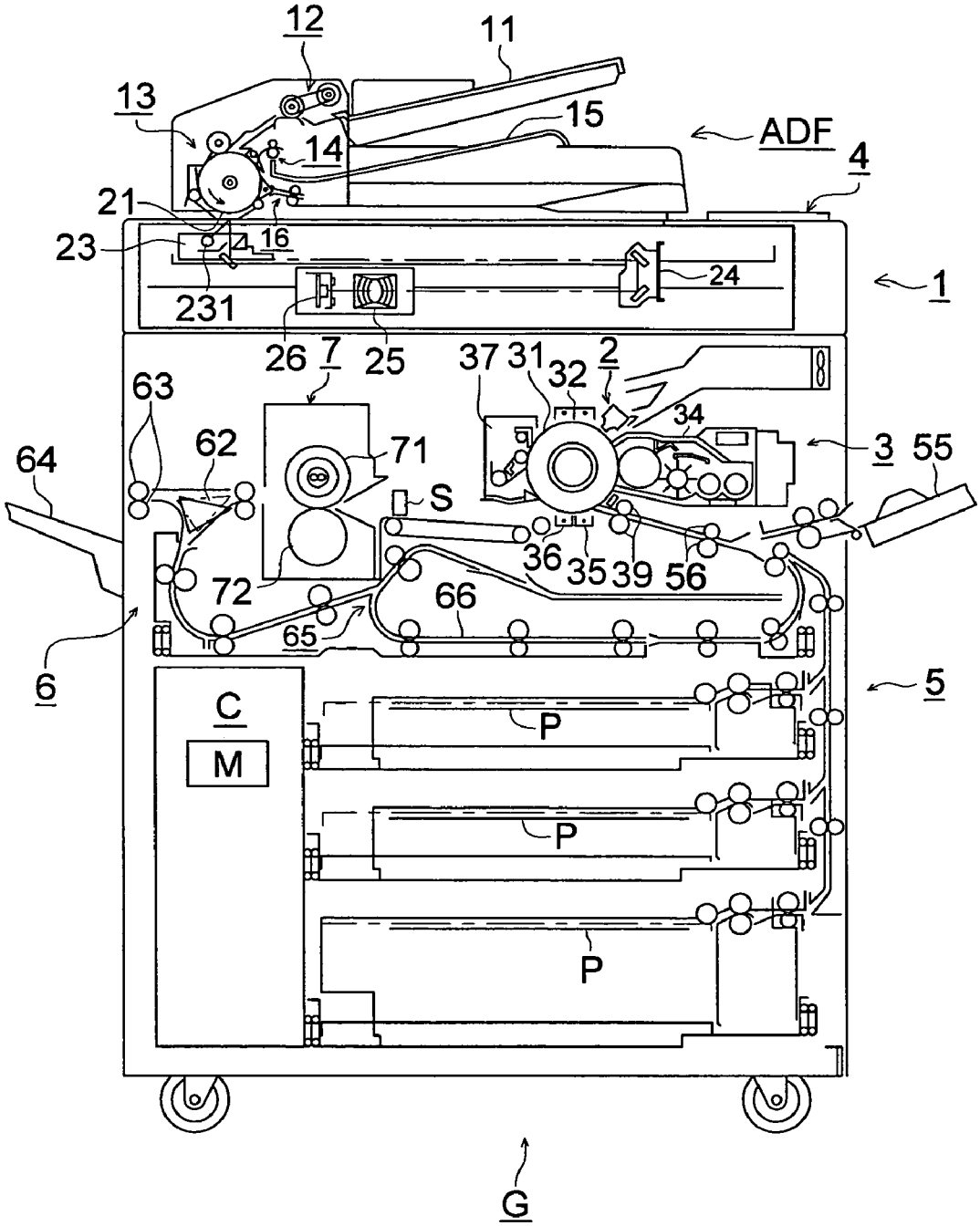
FIG. 1 is a conceptual diagram of an image forming apparatus.

An embodiment of the invention will be explained as follows, referring to the drawings.

FIG. 1 is a schematic structural diagram of image forming apparatus G of a digital type which has functions of a copying machine, a facsimile machine and of a printer and is called a multifunctional machine as an ordinary name.

The image forming apparatus G has, at the upper portion of its main body, automatic document feeder ADF, and the main body is composed of image reading unit 1, image writing unit 2, image forming unit 3, operation and display unit 4, sheet feeding unit 5, ejection and re-feeding unit 6, fixing unit 7 and controller C.

The automatic document feeder ADF feeds out individually, through document separator 12, the documents placed on document tray 11 to document conveyance unit 13, and the document conveyance unit 13 conveys the document sent thereto to document ejection unit 14, while, the document ejection unit 14 conveys the document sent thereto to document ejection tray 15. An image on the document is read through slit 21 representing a document image reading position on the image reading unit 1 provided on a document conveyance path.

When images on both sides of the document are read, the document whose first side has been read is reversed from side to side by document reversing unit 16 having a pair of rollers to be sent out to the document conveyance unit 13 again so that the second side may be read. The document whose both sides have been read is ejected to the document ejection tray 15.

The image reading unit 1 is a unit to read a document image and thereby to obtain image data, and a document image illuminated by lamp 231 at the position of slit 21 is formed as an image on image pickup device 26 representing a linear CCD (Charge Coupled Device), by the first mirror unit 23, the second mirror unit 24 and by image formation lens 25. Signals outputted from the image pickup device 26 are subjected to A/D conversion in an image processing section of controller C, and are stored in memory M as image data after being subjected to processes of shading correction and image compression.

Image writing unit 2 is an LED printing head based on a known technology. Lighting of each LED in LED array is controlled based on image data called from memory M of the controller C and subjected to prescribed image processing, and a circumferential surface of rotating photoreceptor 31 whose surface is charged evenly through corona discharge by charger 32 composed of a charging electrode and a back plate is scanned optically, whereby, an electrostatic latent image corresponding to the document image is formed on the circumferential surface of the photoreceptor 31.

The electrostatic latent image is subjected to reversal development by developing unit 34 of image forming unit 3, and a toner image is formed on the photoreceptor 31.

Recording sheet P is fed from manual feeding unit 55 or from sheet feeding unit.5 having a cassette housing recording sheets P and a tray, to be conveyed by conveyance roller 56, and synchronization in terms of a position between the aforesaid toner image formed on the photoreceptor and the recording sheet is carried out by timing rollers 39, and then, the recording sheet is sent out to a transfer area.

On the transfer area, the toner image formed on the surface of the photoreceptor 31 is transferred onto the recording sheet P that is charged electrically to be in opposite polarity by transfer unit 35.

The recording sheet P carrying the toner image is separated from the surface of the photoreceptor 31 by actions of separation and discharge unit 36, and is sent to fixing unit 7.

In the fixing unit 7, the recording sheet P carrying the toner image is conveyed while it is heated and pressed respectively by heat roller 71 and pressure roller 72, thus, the toner image is fixed on the recording sheet P which is ejected to ejection tray 64 located outside the apparatus.

When ejecting the recording sheet P to the ejection tray 64 after reversing it from side to side, the recording sheet P is led to ejection and re-feeding unit 6 by switching guide 62 so that the recording sheet P switchbacks to be sent to the ejection roller 63.

When forming images on both sides of the recording sheet P, the recording sheet P which has been subjected to fixing on its first surface is led to the ejection and re-feeding unit 6 by the switching guide 62, and it is fed out to conveyance path 66 for sheet feeding after being reversed by reversing section 65, to be ready for image forming on the second surface.

On the other hand, the surface of the photoreceptor 31 from which the toner image has been transferred onto the recording sheet P is cleaned by cleaning unit 37 so that residual toner may be removed to be ready for succeeding image forming.

Figure 2:
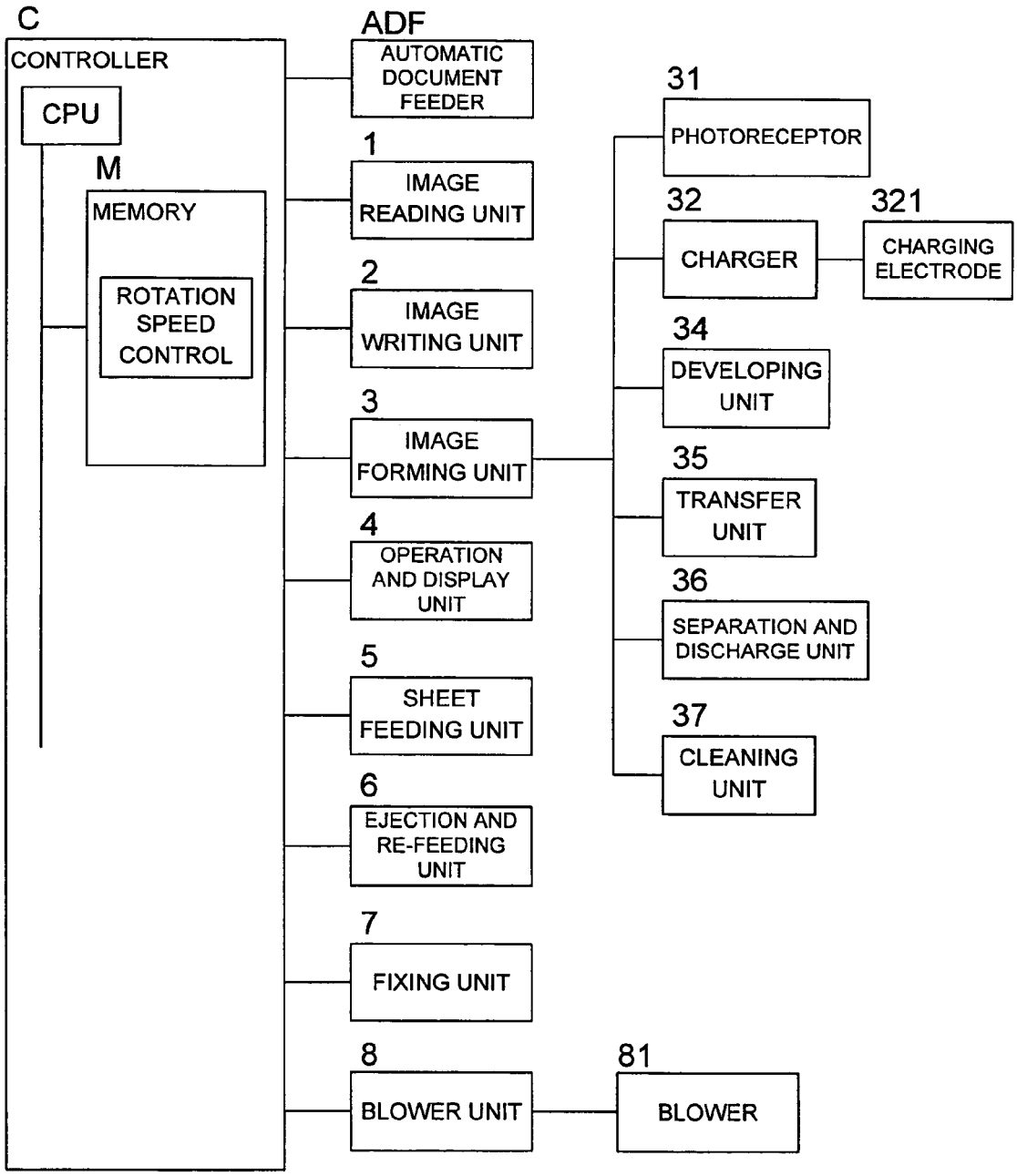
FIG. 2 is a block diagram showing control relations of an image forming apparatus.

FIG. 2 is a block diagram showing control relations of image forming apparatus G.

Controller C is a computer system having CPU, memory M, an operation unit which is not illustrated, I/O port, interface for communication and driving circuits, and it is connected to each illustrated unit, or I/O port corresponding to the apparatus, interface for communication and to driving circuits.

Each type of control for image forming apparatus G by the controller C is carried out by practicing a prescribed program stored in the memory M.

Incidentally, in this drawing, a description of the block that is not connected directly with an explanation of the invention is omitted.

Figure 3:
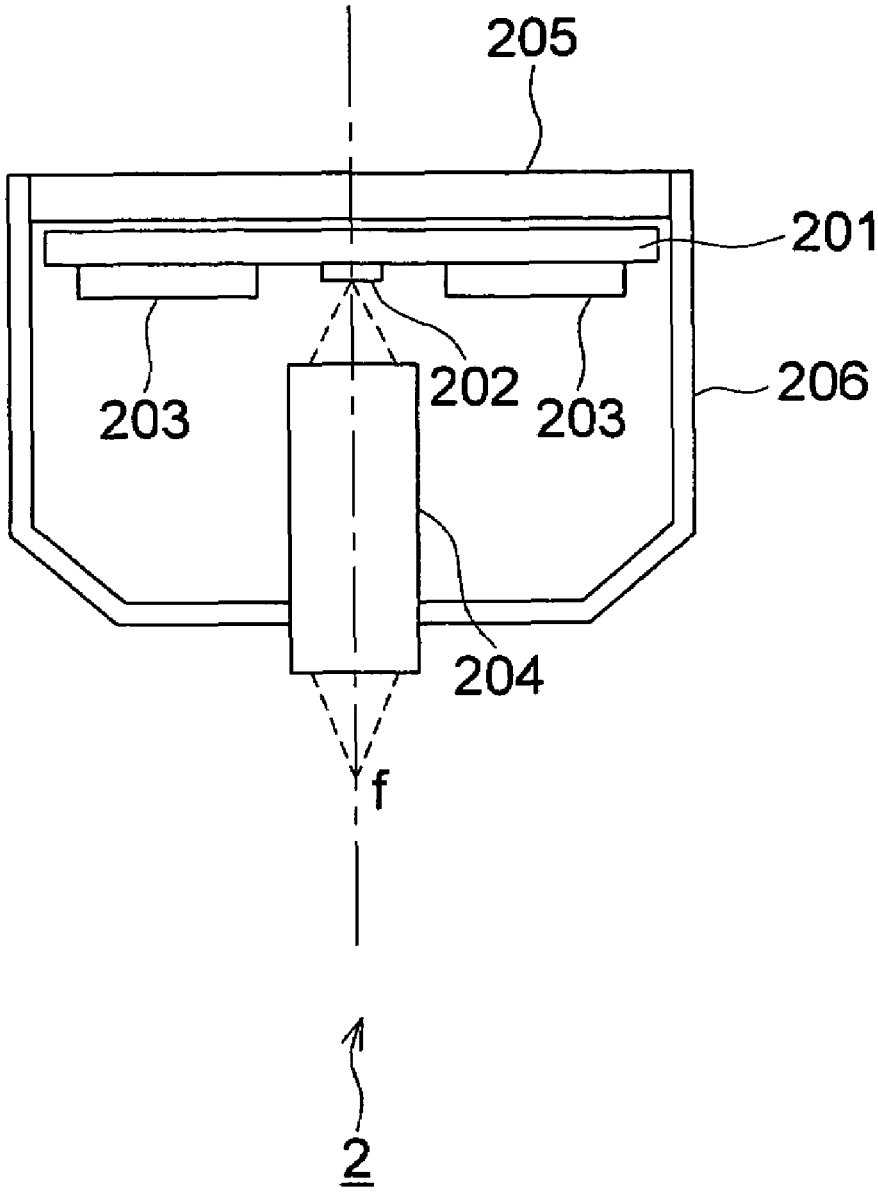
FIG. 3 is a conceptual diagram of an LED printing head.

FIG. 3 is a conceptual diagram of LED printing head 2.

On substrate 201, there are affixed LED array 202 on which a plurality of LEDs are arranged in the depth direction on the drawing, and a plurality of ICs 203 which drive these LEDs. On the front face of the LED array representing a light-emitting section, there is arranged columnar lens array 204, and light emitted from each LED is converged at prescribed focal position f as shown with dotted lines on the drawing. The LED printing head 2 is arranged so that the focal position f may be positioned on the circumferential surface of the photoreceptor 31.

Further, on the substrate 201, there are provided an LED array and radiator plate 205 that discharges heat produced by heat generation of IC 203.

As illustrated, LED array 202, IC 203 and rod lens array 204 are covered by outer package 206 to be united solidly, so that LED printing head 2 is constructed. Owing to the unification of this kind, mounting at a prescribed position in the image forming apparatus G is easy, and dustproof LED array is realized.

Meanwhile, LED printing head 2 shown in the present drawing shows an example which is most common, and some LED printing heads 2 available on the market are different from the present example in terms of arrangement of IC 203 and a shape and arrangement of radiator plate 205. However, effects of the invention remain unchanged even in the aforesaid occasion.

Figure 4:
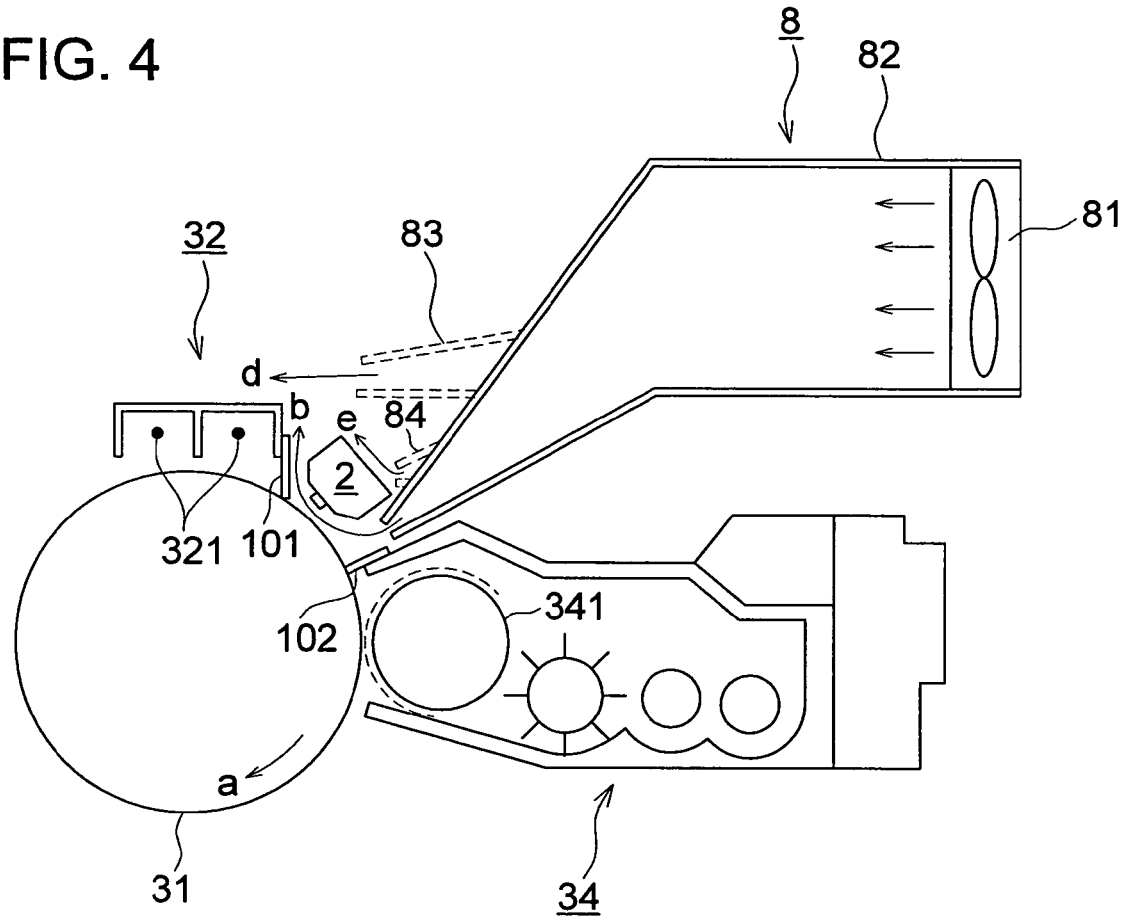
FIG. 4 is a diagram showing a neighborhood of the LED printing head.

FIG. 4 is a diagram showing the neighborhood of the LED printing head 2 in the image forming apparatus G.

On the circumference of the photoreceptor 31 rotating in the direction of arrow "a" in the diagram, there are arranged charger 32 having therein charging electrodes 321, LED printing head 2 representing writing unit 2 and developing unit 34, as shown in the diagram.

In the present invention, first shielding member 101 that isolates spatially charging electrodes 321 from LED printing head 2 is attached on the side of charger 32 as shown in the diagram, and second shielding member 102 that isolates spatially developers in developing unit 34 from LED printing head 2 is attached on the side of the developing unit 34.

Each of the shielding members 101 and 102 is a sheet having abrasion resistance and elasticity, and a 100 μm-thick polyurethane sheet, for example, is used.

Since the shielding members 101 and 102 are attached so that their tips may be in contact with, or may be close to a circumferential surface of the rotating photoreceptor 31 as shown in the diagram, it is prevented that ozone generated by corona discharge of the charging electrodes 321 flows into the tip portion of the LED printing head 2 along the circumferential surface of the rotating photoreceptor 31, and it is prevented that toner in the developing unit 34 scatters to the neighborhood of the LED printing head 2 to adhere to the tip portion of the head.

Blower unit 8 is equipped with blower 81 and guide member 82 representing an air duct. A rotation speed of the blower 81 that determines an amount of air blasting of the blower unit is controlled by controller C.

Air that is taken in from the outside by blower 81 is led to the guide member 82 to be discharged from an opening located at the tip of the guide member 82, and an air flow shown with arrow "b" is formed by a space composed of the second shielding member 102, LED printing head 2 and of the first shielding member 101. This air flow prevents that ozone or toner leaking out slightly from the circumference of aforesaid two shielding members stays at the tip portion of the LED printing head 2, thus, deterioration of the tip portion of the LED printing head 2 by ozone and toner contamination are prevented.

The guide member 83 that forms the second air discharge outlet provided on the guide member 82 shown in the diagram is one provided to create an air flow shown with arrow "d", and this air flow prevents that ozone staying in the neighborhood of charger 32 flows in the direction of the LED printing head 2.

The guide member 84 that forms the third air discharge outlet provided on the guide member 82 shown in the diagram is one provided to create an air flow shown with arrow "e", and this air flow cools radiator plate 205 of the LED printing head 2, and prevents a temperature rise of the LED printing head 2.

As stated above, by providing an air discharge outlet for creating air flow "b", air flow "d" and air flow "e", it is possible to realize simultaneously prevention of deterioration of the tip portion of the LED printing head 2 by ozone and contamination by toner, prevention of flowing of ozone coming from charger 32 into the LED printing head 2 and prevention of heating of the LED printing head 2, without increasing the number of parts and by restraining a larger size of an apparatus to the utmost.

Incidentally, since an amount of generation of ozone generated in the neighborhood of charger 32 is proportional to corona discharge of charging electrode 321, and toner scattering from developing unit 34 is caused by rotation of developing sleeve 341, the rotation speed of blower 81 of blower unit 8 is controlled to match the state of operations of image forming apparatus G, in the present invention.

Figure 5:
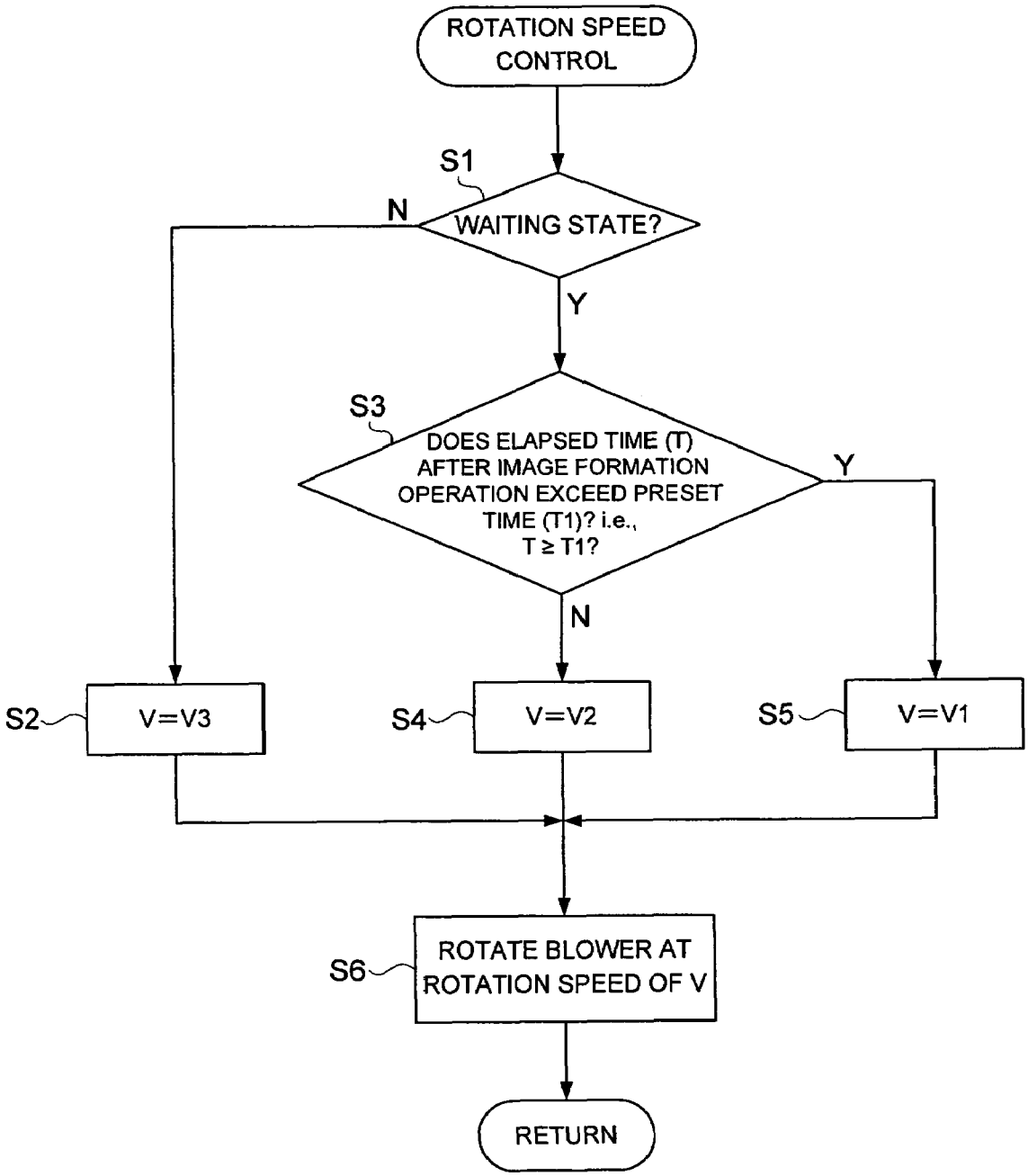
FIG. 5 is a flow chart showing a flow of a rotation speed control of a blower.

FIG. 5 is a flow chart showing a flow of rotation speed control of blower 81 by controller C.

After the program of rotation speed control is practiced, it is judged first by the judging section in the controller whether image forming apparatus G is in the state of image forming operations or in the state of standby (step S1). If the image forming apparatus G is in the state of image forming operations (step S1: N), rotation speed V of blower 81 provided on memory M is set to V3 representing a rotation speed value established in advance in the image forming operations (step S2).

If the image forming apparatus G is not in the state of image forming operation and is in the state of standby (step S1: Y), value T of a timer that counts elapsed time after completion of image forming operations is referred to (step S3), then, if T exceeds time T1 established in advance (step S3: Y), rotation speed V is set to V1 representing the rotation speed value established in advance (step S5), while, if T does not exceed time T1 (step S3: N), rotation speed V is set to V2 representing the rotation speed value established in advance (step S4). Then, the blower is rotated at the established rotation speed V (step S6). After that, the state of operations of the image forming apparatus is judged again, and prescribed operations are repeated.

V1, V2 and V3 are values stored in memory M in advance in a form of a table, and their numerical values are obtained experimentally. Namely, when the image forming apparatus G is in the state of standby, rotation of photoreceptor 31, corona discharge of charger 32 and rotary operations of developing sleeve 341 of developing unit 34 are suspended. Therefore, ozone is not generated newly, therefore, ozone does not flow into the neighborhood of LED printing head 2, toner scarcely scatter and no problem is cause even if an amount of air blasting is lowered, thus, the rotation speed value of blower 81 is set to be low (V=V1).

However, since there exist staying ozone and floating toner for a certain period of time (T1) after image forming operations, the blower 81 is rotated for a period of prescribed time T1 at rotation speed value (V=V2) to cope with the existence of staying ozone and floating toner.

V3 is a rotation speed value in the course o image forming operations, and it is usually in the relationship of V1<V2<V3. However, there are some cases wherein V2=V3 can hold.

BY controlling blower 81 of blower unit 8 as stated above, energy saving and silencing of image forming apparatus G can be realized.

As explained above, by blocking a flow of ozone generated by corona discharge conducted for an LED printing head by the first shielding member, and by blocking toner scattering from a developing unit by the second shielding member, and further, by preventing a stay of ozone and toner in the vicinity of the LED printing head by an air flow, it is possible to realize an image forming apparatus capable of preventing deterioration and contamination of the LED printing head, without providing a specific mechanism on the LED printing head itself. Further, the LED printing head has only to be one having an ordinary and simple mechanism, which results in effects that no cost increase of the apparatus is feared, mounting on the apparatus is simple and maintenance work is easy.

In addition, a guide member that is provided on a blower unit and jets out air flows in plural directions exhibits effects to cool an LED printing head and to prevent a stay of ozone and toner on the circumference of the LED printing head.

BY controlling an amount of air blasting of the blower unit corresponding to operations of the image forming apparatus, it is possible to obtain effects to realize energy saving and silencing of the apparatus.

In the embodiment of the invention, the first shielding member that isolates spatially the LED printing head from the charging electrode prevents that ozone generated from the neighborhood of the charging electrode flows to the tip portion of the print head along the surface of the rotating photoreceptor, the second shielding member that isolates spatially the LED printing head from toner in the developing unit prevents that toner in the developing unit flies to the tip portion of the LED printing head, and an air flow by the blower unit is regulated by the first and second shielding members to pass surely through a space between the printing head and the photoreceptor, in the image forming apparatus of an electrophotographic system equipped with the LED printing head. Thus, an image forming apparatus that prevents a stay of ozone and toner in the tip portion of the LED printing head can be realized.

What is claimed is:

1. An image forming apparatus comprising:

(a) a photoreceptor;

(b) a charger that electrically charges the photoreceptor;

(c) an exposing unit having an LED printing head that forms a latent image on the photoreceptor;

(d) a developing unit that develops a toner image corresponding to the latent image on the photoreceptor;

(e) a blower unit that sends air to a space between the photoreceptor and the LED printing head;

(f) a first shielding member provided on the charger, which intercepts the air coming from the blower unit to enter inside the charger; and (g) a second shielding member provided on the developing unit, which intercepts the air coming from the blower unit to enter inside the developing unit.

2. The image forming apparatus of claim 1, wherein each of the first and second shielding members is a resilient member.

3. The image forming apparatus of claim 1, wherein each of tips of the first and second shielding members is in contact with the photoreceptor.

4. The image forming apparatus of claim 1, wherein the blower unit comprises a guide member which guides an air flow so as to flow from the exposing unit to the charger.

5. The image forming apparatus of claim 1, wherein the exposing unit having the LED printing head, further comprises a radiator plate provided thereon, and the blower unit further comprises a second guide member which guides an air flow so as to flow to the radiator plate.

6. The image forming apparatus of claim 1, further comprising a judgment member which judge a state of operations of the image forming apparatus, and a controller which controls an amount of air blasting of the blower unit according to the state of operations.

7. The image forming apparatus of claim 5, wherein the controller controls so that an amount of air blasting in the state which the image forming apparatus is in operation, is made smaller than that of and amount of air blasting in the state of a standby of the image forming apparatus.

* * * * *